US010001056B2

(12) United States Patent
Hiyoshi et al.

(10) Patent No.: US 10,001,056 B2
(45) Date of Patent: Jun. 19, 2018

(54) INTERNAL COMBUSTION ENGINE WITH VARIABLE COMPRESSION RATIO

(71) Applicant: NISSAN MOTOR CO., LTD., Yokohama-shi, Kanagawa (JP)

(72) Inventors: Ryosuke Hiyoshi, Atsugi (JP); Katsutoshi Nakamura, Atsugi (JP); Takeharu Sugita, Kawasaki (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days. days.

(21) Appl. No.: 14/760,274

(22) PCT Filed: Dec. 16, 2013

(86) PCT No.: PCT/JP2013/083616
§ 371 (c)(1),
(2) Date: Jul. 10, 2015

(87) PCT Pub. No.: WO2014/112266
PCT Pub. Date: Jul. 24, 2014

(65) Prior Publication Data

US 2015/0354448 A1 Dec. 10, 2015

(30) Foreign Application Priority Data

Jan. 17, 2013 (JP) ..... 2013-006393

(51) Int. Cl.
*F02B 75/04* (2006.01)
*F02F 7/00* (2006.01)

(52) U.S. Cl.
CPC ..... *F02B 75/047* (2013.01); *F02B 75/045* (2013.01); *F02F 7/0053* (2013.01)

(58) Field of Classification Search
CPC .... F02B 75/048; F02B 75/045; F02B 75/047; F02F 2007/0056
(Continued)

(56) References Cited

U.S. PATENT DOCUMENTS 6,647,935 B2 * 11/2003 Aoyama ..... F01L 1/024 123/198 F
6,920,847 B2 7/2005 Hiyoshi et al.
(Continued)

FOREIGN PATENT DOCUMENTS

CN 101446237 A 6/2009
CN 101560917 A 10/2009
(Continued)

*Primary Examiner* — Long T Tran
(74) *Attorney, Agent, or Firm* — Drinker Biddle & Reath LLP

(57) ABSTRACT

It has variable compression ratio mechanism (10) that changes engine compression ratio depending on the rotational position of first control shaft (14). First control shaft (14) and second control shaft, which is connected to a motor, are coupled together by lever (24) of coupling mechanism (20). First arm portion (25) of first control shaft (14) and one end of lever (24) are rotatably coupled together by first coupling pin (26). When viewed in the axial direction of this first coupling pin (26), at least at a given compression ratio position, first coupling pin (26) is arranged at a position away from bearing cap (30) that is for rotatably supporting first control shaft (14).

11 Claims, 5 Drawing Sheets

(58) Field of Classification Search
USPC ..... 123/48 R, 48 A, 48 B, 78 R, 78 A, 78 E, 123/78 F
See application file for complete search history.

(56) References Cited

U.S. PATENT DOCUMENTS

| | | | | |
|---|---|---|---|---|
| 7,191,741 | B2 * | 3/2007 | Hiyoshi | F02B 75/048 123/48 B |
| 7,350,506 | B2 * | 4/2008 | Maezuru | F02B 75/048 123/197.4 |
| 7,966,980 | B2 | 6/2011 | Lee et al. | |
| 8,015,955 | B2 * | 9/2011 | Maezuru | F02D 15/02 123/48 B |
| 2003/0019448 | A1 * | 1/2003 | Aoyama | F01L 1/024 123/90.16 |
| 2006/0096810 | A1 * | 5/2006 | Eto | F01M 11/02 184/6.5 |
| 2009/0038588 | A1 * | 2/2009 | Hiyoshi | F02B 75/048 123/48 B |
| 2010/0018504 | A1 * | 1/2010 | Tanaka | F01L 1/022 123/48 B |
| 2010/0192915 | A1 * | 8/2010 | Tanaka | F02B 75/048 123/48 B |

FOREIGN PATENT DOCUMENTS

| | | | |
|---|---|---|---|
| JP | 2002-047955 | A | 2/2002 |
| JP | 2003-322036 | A | 11/2003 |
| JP | 2004-257254 | A | 9/2004 |
| JP | 2008-025431 | A | 2/2008 |
| JP | 2010-216276 | A | 9/2010 |
| JP | 2011-169152 | A | 9/2011 |
| JP | 2011-241796 | A | 12/2011 |

* cited by examiner

INTERNAL COMBUSTION ENGINE WITH VARIABLE COMPRESSION RATIO

TECHNICAL FIELD

The present invention relates to an internal combustion engine with a variable compression ratio, which is equipped with a variable compression ratio mechanism capable of varying the engine compression ratio.

BACKGROUND TECHNOLOGY

Hitherto, the present applicant has proposed a variable compression ratio mechanism capable of varying the engine compression ratio by using a multi-link type, piston-crank mechanism (for example, see Patent Publication 1). Such variable compression ratio mechanism is capable of changing and controlling the engine compression ratio depending on the engine operation condition by changing the rotational position of the first control shaft by an actuator such as motor.

PRIOR ART REFERENCE

Patent Publication

Patent Publication 1: Japanese Patent Application Publication 2004-257254

SUMMARY OF THE INVENTION

Task to be Solved by the Invention

In the case of a structure in which an actuator of the variable compression ratio mechanism is arranged outside of the engine body for protecting from oil, exhaust heat, etc., for example, the actuator and the first control shaft are coupled with each other by a coupling mechanism equipped with a lever passing through a side wall of the engine body. One end of the lever is coupled with the first control shaft through a first coupling pin. A journal portion of the first control shaft is rotatably supported on the engine body by using a bearing cap that is fixed to the engine body.

In the variable compression ratio internal combustion engine having such structure, viewed in the axial direction of the first coupling pin, if the external form of the bearing cap and the first coupling pin (in other words, a pin hole allowing this first coupling to pass therethrough) are overlapped with each other, it is necessary to once detach the bearing cap in order to secure a space for allowing insertion of the first coupling pin. This worsens the assembly workability.

Thus, it is an object of the present invention to provide a novel variable compression ratio internal engine capable of improving the assembly workability.

Means for Solving the Task

A variable compression ratio mechanism according the present invention has a variable compression ratio mechanism for changing the engine compression ratio depending on the rotational position of the first control shaft, an actuator for changing and maintaining the rotational position of the first control shaft, and a coupling mechanism for coupling the actuator and the first control shaft. This coupling mechanism has a second control shaft arranged in parallel with the first control shaft, a lever for coupling the first control shaft and the second control shaft, a first coupling pin for rotatably coupling a tip end of a first arm portion extending outward in the radial direction from the center of the first control shaft and one end of the lever, and a second coupling pin for rotatably coupling a tip end of a second arm portion extending outward in the radial direction from the center of the second control shaft and another end of the lever. Furthermore, it has a bearing cap that is fixed to the engine body and rotatably supports a journal portion of the first control shaft. Then, it is characterized by that, viewed in the axial direction of the first coupling pin, at least at a given compression ratio position, the first coupling pin is arranged at a position away from the bearing cap.

Advantageous Effect of the Invention

According to the present invention, at least at a given compression ration position, the first coupling pin is arranged at a position away from the bearing cap. Therefore, it becomes possible to couple the lever and the first control shaft by the first coupling pin on the side of the first coupling pin without removing the bearing cap. This greatly improves the assembly workability.

MODE FOR IMPLEMENTING THE INVENTION

Figure 1:
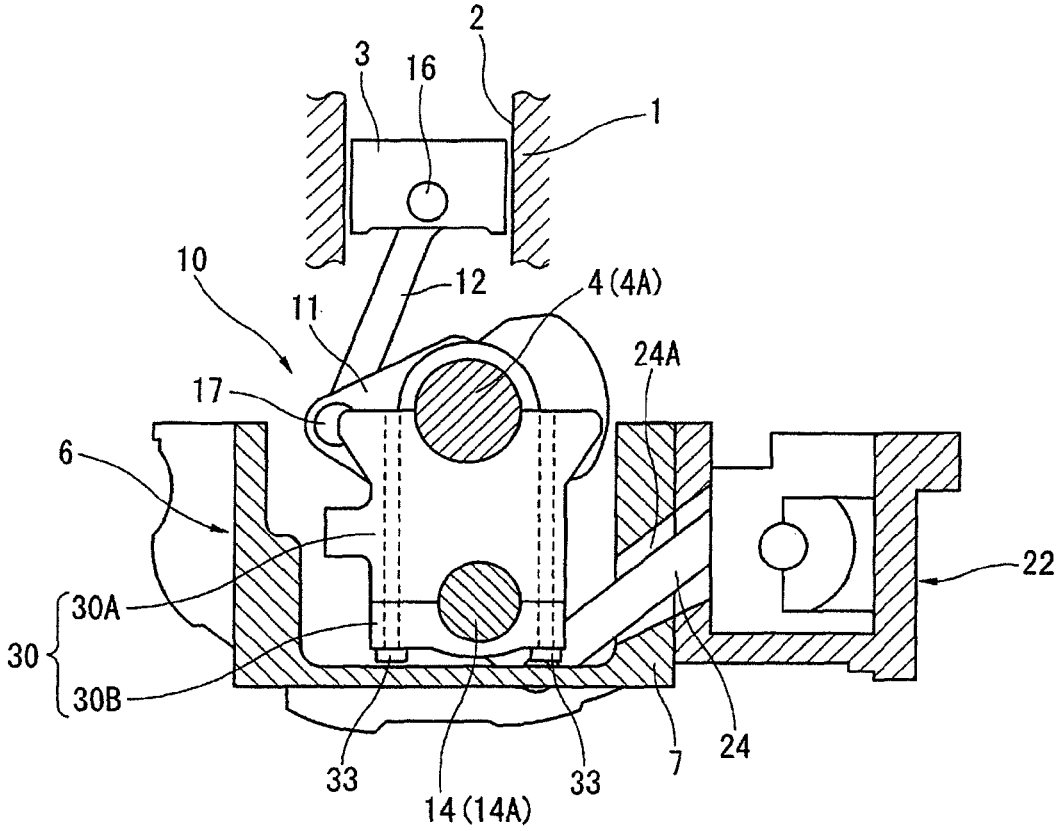
FIG. 1 is a sectional view showing a variable compression ratio internal combustion engine equipped with a variable compression ratio mechanism according to an embodiment of the present invention.

In the following, a preferable embodiment of the present invention is explained in detail with reference to the drawings. FIGS. 2 to 5 have been drawn by simplifying FIG. 1, but all of FIGS. 1 to 5 are sectional views showing the same embodiment. Firstly, variable compression ratio mechanism 10 using a multi-link type, piston-crank mechanism 10 is explained. As this mechanism 10 is described in the above-mentioned Japanese Patent Application Publication 2004-257254, etc., it is publicly known. Therefore, it is limited to a brief explanation.

In cylinder block 1 constituting a part of the engine body of the internal combustion engine, piston 3 of each cylinder is slidably fit in cylinder 2, and crankshaft 4 is rotatably supported. Variable compression ratio mechanism 10 has lower link 11 that is rotatably attached to crankpin 5 of crankshaft 4, upper link 12 for coupling this lower link 11 and piston 3, first control shaft 14 that is rotatably supported on the engine body side such as cylinder block, eccentric shaft portion 15 eccentrically formed on this first control shaft 14, and control link 13 for coupling this eccentric shaft portion 15 and lower link 11. Piston 3 and the upper end of upper link 12 are relatively rotatably coupled through piston pin 16. The lower end of upper link 12 and lower link 11 are relatively rotatably coupled through upper link side coupling pin 17. The upper end of control link 13 and lower link 11 are relatively rotatably coupled through control link side coupling pin 18. The lower end of control link 13 is rotatably attached to the above-mentioned eccentric shaft portion 15.

Motor 19 as an actuator of this variable compression mechanism 10 is coupled with first control shaft 14 through coupling mechanism 20 equipped with speed reducer 21. By changing the rotational position (angle) of first control shaft 14 by this motor 19, with the change of position of lower link 11, piston stroke characteristics including the piston top dead center and the piston bottom dead center change, and the engine compression ratio changes. Therefore, it is possible to control the engine compression ratio depending on the engine operation condition by controlling drive of motor 19 by a control section not shown in the drawings. The actuator is not limited to electric motor 19, but may be a hydraulic drive actuator.

First control shaft 14 is rotatably supported in the inside of the engine body, which is formed of cylinder block 1, oil pan upper 6 fixed thereunder, etc. On the other hand, motor 19 is arranged outside of the engine body. In more detail, it is attached on the engine rear side of housing 22 attached to intake-side side wall (hereinafter referred to as "oil pan side wall") 7 of oil pan upper 6, which constitutes a part of the engine body.

Speed reducer 21 is one for slowing down the rotation of an output shaft of motor 19 and transmitting the same to first control shaft 14. For example, one having a structure utilizing a strain wave gearing mechanism is used. The speed reducer is, however, not limited to a structure utilizing such strain wave gearing mechanism. It is also possible to use another type of speed reducer, such as cyclo-speed reducer.

Coupling mechanism 20 is formed with second control shaft 23 having a structure integral with the output shaft of speed reducer 21. It may have a structure in which the output shaft of speed reducer 21 and second control shaft 23 are separately formed and in which both are coupled to rotate in an interlocking manner.

This second control shaft 23 is rotatably received and arranged in housing 22 attached alongside oil pan side wall 7 and extends in the engine front-back direction (i.e., the direction parallel with first control shaft 14) along oil pan side wall 7. First control shaft 14, which is arranged in the inside of the engine body where lubricating oil splashes, and second control shaft 23, which is placed outside of the engine body, are mechanically coupled by lever 24 passing through oil pan side wall 7 and both 14, 23 are rotated in an interlocking manner. Slit 24A for allowing passing through of lever 24 is formed through oil pan side wall 7 and housing 22. Housing 22 is fluid-tightly attached to oil pan side wall 7 in a manner to seal surroundings of this slit 24A.

One end of lever 24 and the tip end of first arm portion 25 extending outward in the radial direction from the center of first control shaft 14 are relatively rotatably coupled through first coupling pin 26. The other end of lever 24 and the tip end of second arm portion 27 extending outward in the radial direction from the center of second control shaft 23 are coupled through second coupling pin 28.

By such link mechanism, as first control shaft 14 rotates, the engine compression ratio changes, and the positions of first arm portion 25, second arm portion 27 and lever 24 change. Therefore, the speed reduction ratio of the rotational power transmission route from motor 19 to first control shaft 14 also changes.

Main journal portion 4A of crankshaft 4 and journal portion 14A of first control shaft 14 are rotatably supported on the engine body side by bearing cap 30 fixed to cylinder block 1 as the engine body. Bearing cap 30 is made up of major bearing cap 30A and minor bearing cap 30B. Both are fixed on the bottom surface side of a bulkhead (not shown in the drawings) of cylinder block 1. First control shaft 14 is rotatably supported between major bearing cap 30A and the bulkhead, and second control shaft 23 is rotatably supported between major bearing cap 30A and minor bearing cap 30B.

Figure 4:
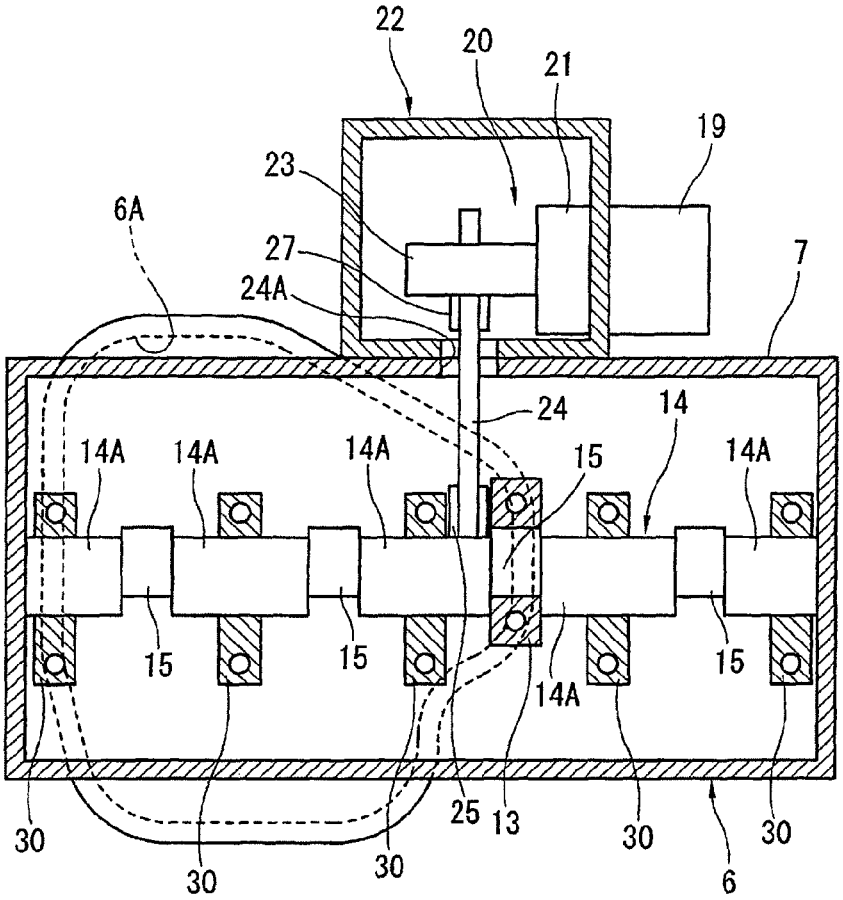
FIG. 4 is a transverse sectional view showing the variable compression ratio internal combustion engine.

As shown in FIG. 4, first control shaft 14 is provided with eccentric shaft portion 15 for each cylinder, and this eccentric shaft portion 15 and journal portion 14A are alternately provided. Bifurcated first arm portion 25, into which first coupling pin 26 is inserted, is arranged in a space between bearing cap 30 at the center in the direction of cylinder line and control link 13. There are provided gaps, each being small (for example, 2 to 3 mm), between one side surface of this first arm portion 25 and bearing cap 30 and between the other side surface of this first arm portion 25 and control link 13.

Next, characteristic structure and advantageous effects of this embodiment are cited in the following.

Figure 2:
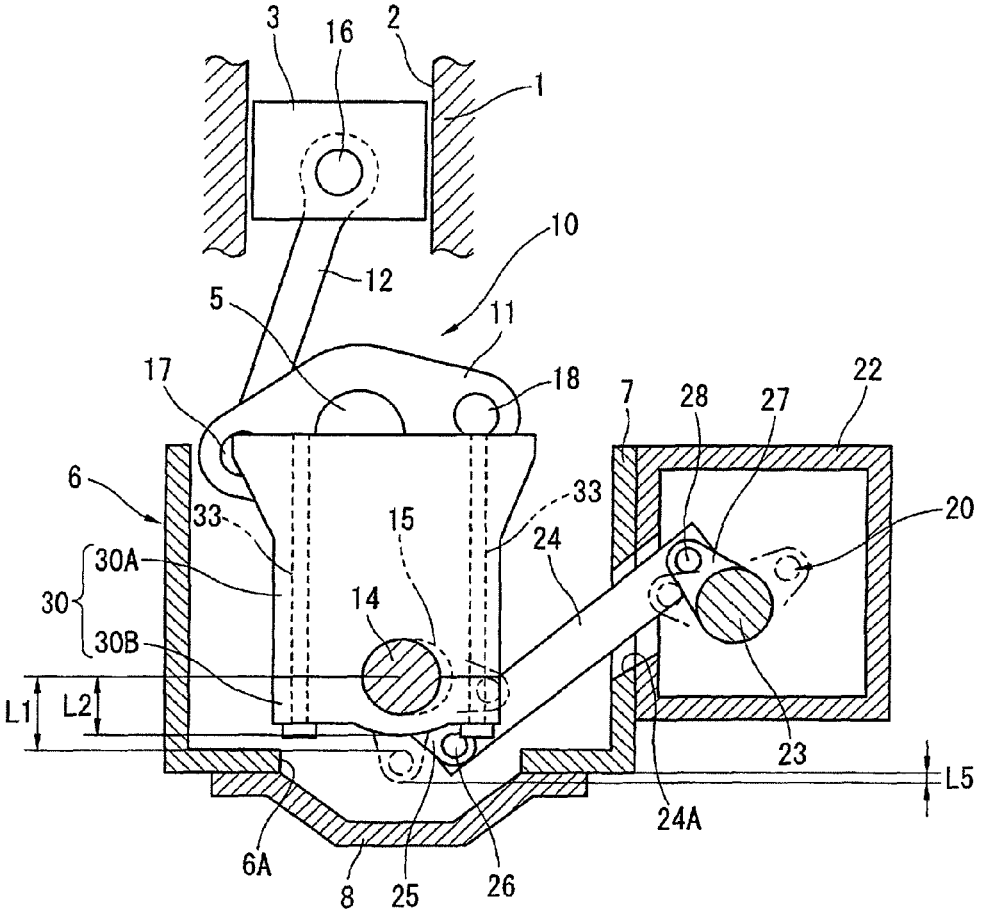
FIG. 2 is a sectional view showing the variable compression ratio internal combustion engine.

[1] As shown in FIG. 2, in the view in the crankshaft direction as observed in the axial direction of first coupling pin 26, at least at a given compression ratio position, specifically at a compression ratio position at which first arm portion 25 is the most downwardly oriented, first coupling pin 26 is arranged at a position downwardly away from bearing cap 30. That is, a pin hole of first coupling pin 26 is configured so as not to overlap with the existence range of bearing cap 30.

By such structure, the following advantageous effects are obtained. Firstly, it becomes possible to couple lever 24 and first control shaft 14 together by first coupling pin 26 in a condition that bearing cap 30 has been mounted on the side of cylinder block 1, and there is no need to remove bearing cap 30. Therefore, the assembly workability is improved.

Secondly, since it is possible to easily couple lever 24 and first control shaft 14 together without removing bearing cap 30 as mentioned above, it becomes possible to previously couple lever 24 to the side of second control shaft 23 through second coupling pin 28 to make a unit having a condition in which lever 24 has previously been coupled to the side of housing 22. This makes it possible to conduct transportation and delivery of the housing in the form of this unit. Therefore, the working efficiency upon assembly improves. Furthermore, since it is not necessary to divide the side of housing 22 when housing 22 is coupled with the engine body, it is possible to suppress and prevent contamination of the housing 22, which receives speed reducer 21, etc., with foreign substances, thereby improving quality.

Thirdly, load acting on lever 24 is relatively reduced by increasing the size of first arm portion 25 to arrange first coupling pin 26 at a position away from bearing cap 30. With this, it is possible to reduce the input load acting on the side of second control shaft 23 or motor 19 in housing 22 from the side of variable compression ratio mechanism 10 through lever 24. Furthermore, in case that an angle sensor is attached to the output shaft of motor 19, vibration of this angle sensor is reduced. This makes it possible to improve the detection accuracy.

Fourthly, as the input load on second control shaft 23 is reduced as mentioned above, it is possible to reduce the bearing load of second control shaft 23 to suppress wear of this bearing portion.

Fifthly, as the input load on second control shaft 23 is reduced as mentioned above, it is possible to reduce the bearing pressure of second coupling pin 28. With this, it is possible to reduce the pin hole diameter and the thickness of a pin boss portion at the tip end of second arm portion 28 of second control shaft 23, into which this second coupling pin 28 is inserted. As a result, although the size of first arm portion 25 has been increased as mentioned above, it is possible to make second control shaft 23 compact and prevent the increase of the size on the side of housing 22.

Sixthly, it is possible to suppress the input load on first coupling pin 26 and suppress wear of its bearing portion. Furthermore, as the size of first arm portion 25 increases, it becomes a structure in which first control shaft 14 and lever 24 hardly interfere with each other. With this, it becomes unnecessary to provide a notch or the like for avoiding interference of them. Therefore, while sufficiently maintaining the thickness of surroundings of oil galleries of first control shaft 14, it is possible to improve the lubrication capability by largely forming the oil galleries.

Seventhly, due to reducing the input load on the side of housing 22 as mentioned above, it is possible to suppress the input load on oil pan upper 6, to which this housing 22 is attached, to suppress deformation of oil pan upper 6. As a result, it is possible to suppress variation of the compression ratio due to deformation of oil pan upper 6, suppress the excessive increase of combustion pressure due to resonance and the excessively high compression ratio, and avoid an abnormal load input on the actuator. Furthermore, while maintaining strength and stiffness of the oil pan, its downsizing and weight reduction are possible.

Eighthly, due to reducing the input load on lever 24 as mentioned above, load acting on the bearing portion of first control shaft 14 is also reduced. As a result, it is possible to suppress deformation in the direction, in which the bulkhead or bearing cap 30 falls down, and suppress and prevent an abnormal load input on the side of motor 19 due to abnormal behavior of the main moving system.

[2] More specifically, as shown in FIG. 2, the shortest distance between first coupling pin 26 and the center of first control shaft 14 (the distance obtained by subtracting the radius of first coupling pin 26 from the distance from the center of first coupling pin 26 to the center of first control shaft 14) L1 is set to be larger than the shortest distance between the lower end of bearing cap 30 and the center of the first control shaft. By such setting, as mentioned above, first coupling pin 26 is arranged at a position away from bearing cap 30 at a given compression ratio position.

[3] As viewed in the axial direction of first coupling pin 26, first coupling pin 26 is arranged at a position away from control link 13 too, at least at a given compression ratio position.

Due to this, as also shown in FIG. 4, first arm portion 25, into which first coupling pin 26 is inserted, is arranged between control link 13 and bearing cap 30 with a small gap of about 2-3 mm. Due to the above structure, when coupling first coupling pin 26, it is also possible to suppress and avoid interference with control link 13. Therefore, it is possible to couple lever 24 and first control shaft 14 together by first coupling pin 26 without removing control link 13. As a result, even if first coupling pin 26 is inserted from the side of control link 13, it is possible to obtain an advantageous effect similar to that in the case of inserting first coupling pin 26 from the side of bearing cap 30 in the above-mentioned [1].

Figure 3:
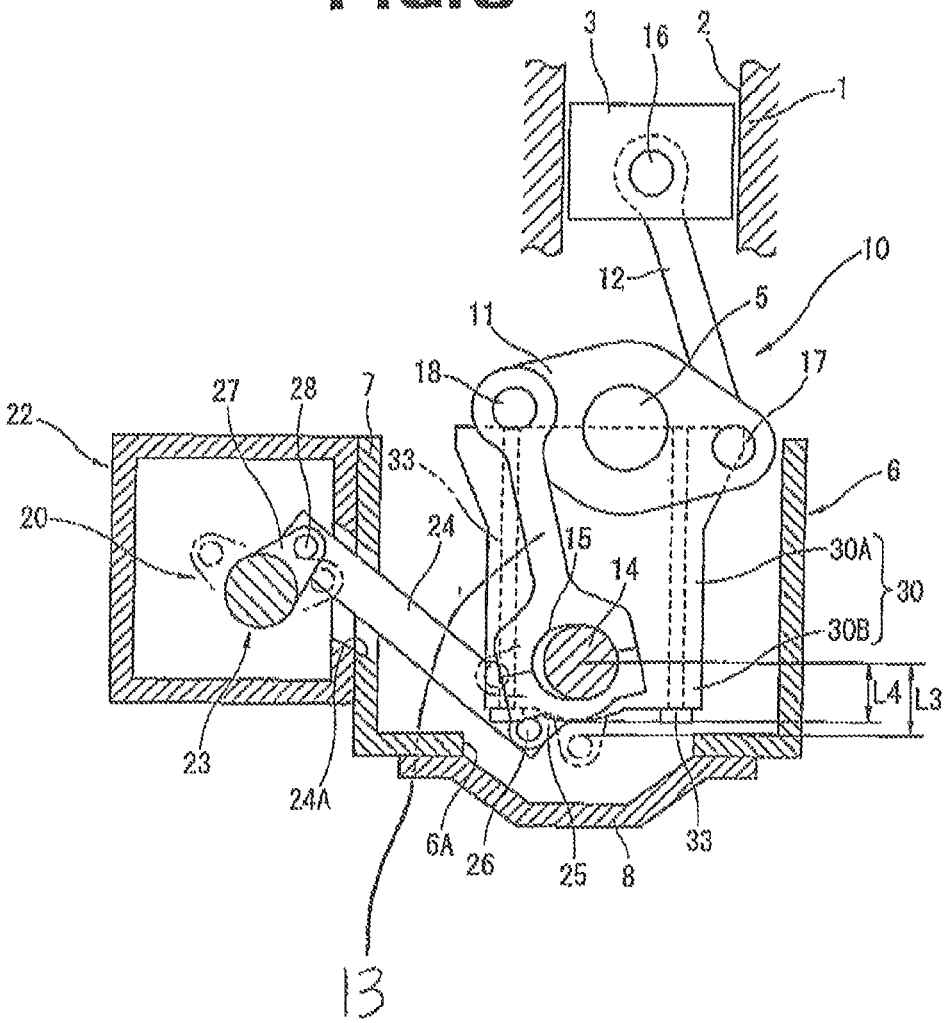
FIG. 3 is a sectional view in a direction opposite to FIG. 2, showing the variable compression ratio internal combustion engine.

[4] Specifically, as also shown in FIG. 3, the shortest distance L3 between first coupling pin 26 and the center of first control shaft 14 is set to be larger than the shortest distance L4 between the lower end of control link 13 and the center of first control shaft 14. Due to this, as mentioned in the above [3], as viewed in the axial direction of first coupling pin 26, there is provided a structure in which first coupling pin 26 is arranged at a position away from control link 13 too, at least at a given compression ratio position.

[5] More specifically, as shown in FIG. 2 and FIG. 3, when being at a position at which the tip end of first arm portion 25 is downwardly oriented relative to the center of first control shaft 14, it becomes the above-mentioned given compression ratio position. With this, first coupling pin 26 is arranged at a position away from both of bearing cap 30 and control link 13.

[6] On a bottom surface side of oil pan upper 6, opening portion 6A is formed to have an opening. In a manner to close this opening portion 6A, oil pan lower 8 having a shallow pan form is attached. These oil pan upper 6 and oil pan lower 8 constitute an oil pan for storing engine oil. It is set that opening portion 6A of oil pan upper 6 is positioned below first coupling pin 26. That is, it is constructed that first coupling pin 26 is arranged above opening portion 6A of oil pan upper 6.

Due to this, under a condition that first control shaft 14 and oil pan upper 6 have been attached to the engine body side, it becomes possible to couple lever 24 and first control shaft 14 together by first coupling pin 26 through opening portion 6A of oil pan upper 6. Therefore, as mentioned above, under a condition of a unit in which lever 24 has previously been coupled to the side of housing 22, it becomes possible to couple this lever 24 with first control shaft 14, which is attached to the engine body, through first coupling pin 26. This remarkably improves workability. Furthermore, it becomes possible to make a coupling in a condition that motor 19 and speed reducer 21 have been installed in housing 22, that is, in a condition that quality assurance has been made. With this, it is possible to seek quality improvement.

Figure 5:
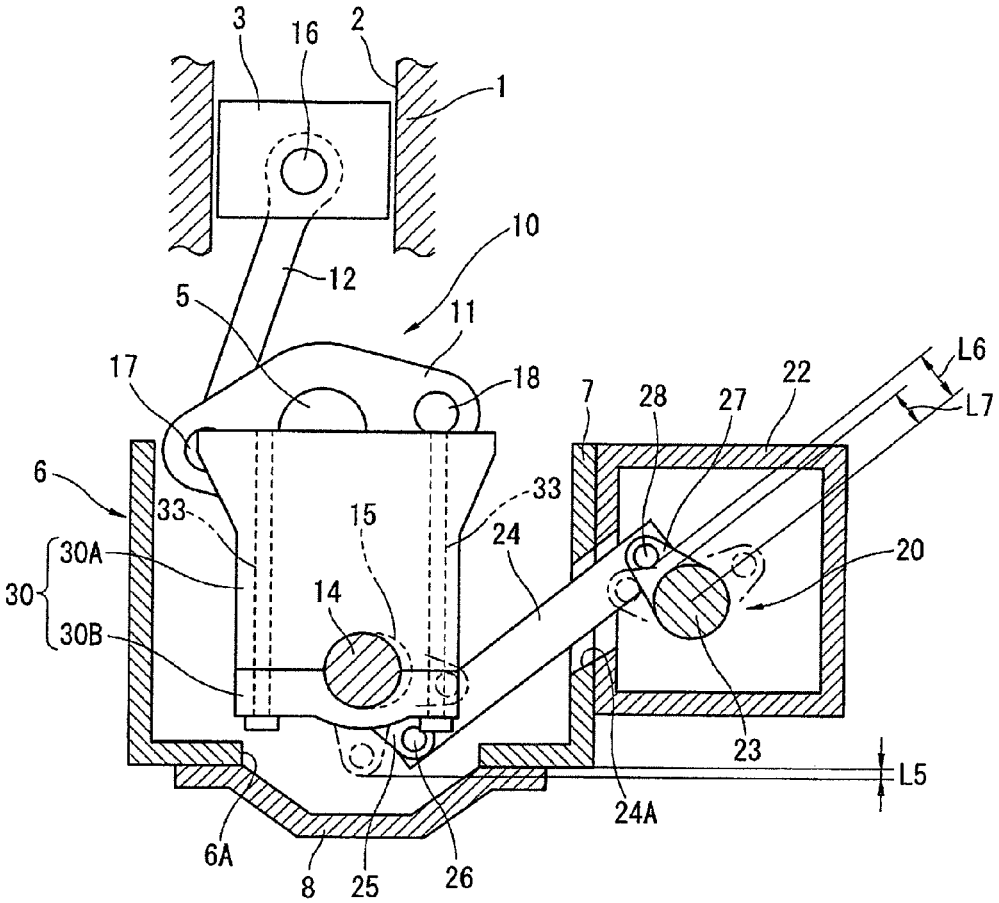
FIG. 5 is a sectional view showing the variable compression ratio internal combustion engine.

[7] Furthermore, as shown in FIG. 5, at a given compression ratio position, that is, at a position that the tip end of first arm portion 25 is oriented downwardly (the direction toward the side opposite to the combustion chamber along the cylinder axis direction, that is, the direction toward the crankcase side), the tip end of first arm portion 25 is positioned below the lower end of oil pan upper 6 by a given distance L5. Thus, the tip end of this first arm portion 25 downwardly projects from opening portion 6A of oil pan upper 6.

By making the tip end of first coupling pin 26 downwardly project from opening portion 6A in this manner, when coupling first coupling pin 26, it becomes possible to visually detect the lower end portion of first arm portion 25, with which this first coupling pin 26 is coupled. With this, it is possible to further improve workability upon assembly.

[8] As further mentioned, at a position of the maximum compression ratio or the minimum compression ratio, that is, at a rotational position at which first control shaft 14 has been turned the most, it becomes the above-mentioned given compression ratio position, and first coupling pin 26 is arranged at a position away from both of bearing cap 30 and control link 13.

[9] As shown in FIGS. 2, 3 and 5, it is set that the direction of first arm portion 25 projecting from a straight line passing through the center of first control shaft 14 and the direction of second arm portion 27 projecting from a straight line passing through the center of second control shaft 23 are opposite to each other.

By making the projection directions opposite to each other in this manner, as compared with the case of setting them in the same direction, it is possible to shorten the length of lever 24 to improve stiffness of lever 24. As a result, it is possible to suppress resonance to reduce vibration of motor 19 or the angle sensor to be attached to this motor 19.

Secondly, it is possible to reduce load acting on the bearing portion of first control shaft 14 by making the angle between lever 24 and control link 13 narrow. As a result, it is possible to suppress the falling deformation of the bulkhead or bearing cap 30.

Thirdly, due to making the projection directions opposite to each other, it is possible to arrange slit 24A of oil pan side wall 7, through which lever 24 passes, within a range of the side wall of housing 22, which is fixed to oil pan side wall 7 of oil pan upper 6. Therefore, slit 24A is not formed in a manner to extend to cylinder block 1 or oil pan lower 8. With this, it is possible to suppress and avoid lowering of stiffness and lowering of sealing property, which follow the formation of slit 24A.

[10] Furthermore, as shown in FIG. 5, the shortest distance L6 between second coupling pin 28 and the center of second control shaft 23 is set to be larger than radius L7 of journal portion 23A of second control shaft 23, which is rotatably supported by housing 22.

Due to this, second arm portion 28 is in a form of outwardly projecting from journal portion 23A in the radial direction. With this, a pin hole of second control shaft 23, into which second coupling pin 28 is inserted, does not overlap with journal portion 23A, and it is possible to easily machine this pin hole. Furthermore, it becomes possible to set the speed reduction ratio property by coupling mechanism 20 at an appropriate one by increasing the length of second arm portion 27 too in accordance with the increase of the length of first arm portion 25 as mentioned above.

As above, the present invention has been explained based on a specific embodiment. The present invention is, however, not limited to the above embodiment, but includes various modifications and changes. For example, the control link is coupled with the lower link in the above-mentioned variable compression ratio mechanism, but it is optional to provide a structure in which the control link is coupled with the upper link.

The invention claimed is:

1. A variable compression ratio internal combustion engine, comprising:

a variable compression ratio mechanism for changing an engine compression ratio depending on a rotational position of a first control shaft;

an actuator for changing and maintaining the rotational position of the first control shaft; and a coupling mechanism for coupling the actuator and the first control shaft, the coupling mechanism comprising:

a lever for coupling the first control shaft and the actuator;

a first coupling pin for rotatably coupling a tip end of a first arm portion extending outward in a radial direction from a center of the first control shaft and one end of the lever; and a second arm portion for coupling another end of the lever and the actuator;

the engine further comprising a bearing cap that is fixed to an engine body and rotatably supports a journal portion of the first control shaft, wherein, viewed in an axial direction of the first coupling pin, at least at a given compression ratio position, the first coupling pin is arranged at a position away from the hearing cap, wherein, furthermore, an oil pan for storing engine oil is formed on a bottom surface thereof with an opening portion, and wherein the opening portion is positioned below the first coupling pin.

2. The variable compression ratio internal combustion engine as claimed in claim 1, wherein a shortest distance between the first coupling pin and the center of the first control shaft is set to be larger than a shortest distance between a lower end of the bearing cap and the center of the first control shaft.

3. The variable compression ratio internal combustion engine as claimed in claim 1, wherein the variable compression ratio mechanism comprises a lower link that is rotatably attached to a crankpin of a crankshaft, an upper link for coupling the lower link and a piston, and a control link for coupling an eccentric shaft portion, which is eccentrically formed on the first control shaft, with the lower link or the upper link, and wherein, viewed in the axial direction of the first coupling pin, at least, at the given compression ratio position, the first coupling pin is arranged at a position away from the control link.

4. The variable compression ratio internal combustion engine as claimed in claim 3, wherein a shortest distance between the first coupling pin and the center of the first control shaft is set to be larger than a shortest distance between a lower end of the bearing cap and the center of the first control shaft.

5. The variable compression ratio internal combustion engine as claimed in claim 1, wherein, at the given compression ratio position, the tip end of the first arm portion is downwardly oriented relative to the center of the first control shaft.

6. The variable compression ratio internal combustion engine as claimed in claim 1, wherein, at the given compression ratio position, the tip end of the first UM portion downwardly projects from the opening portion of the oil pan upper.

7. The variable compression ratio internal combustion engine as claimed in claim 1, wherein the given compression ratio position is a position of a maximum compression ratio or a minimum compression ratio.

8. The variable compression ratio internal combustion engine as claimed in claim 1, wherein the coupling mechanism further comprises:

a second control shaft that is arranged in parallel with the first control shaft and is coupled with the first control shaft by the lever; and a second coupling pin for rotatably coupling a tip end of the second arm portion extending outward in a radial direction from a center of the second control shaft and the another end of the lever, wherein a direction of the first arm portion projecting from a straight line passing through the center of the first control shaft and a direction of the second arm portion projecting from a straight line passing through the center of the second control shaft are set to be opposite to each other.

9. The variable compression ratio internal combustion engine as claimed in claim 1, wherein the coupling mechanism further comprises:

a second control shaft that is arranged in parallel with the first control shaft and is coupled with the first control shaft by the lever; and a second coupling pin for rotatably coupling a tip end of the second arm portion extending outward in a radial direction from a center of the second control shaft and the another end of the lever, wherein a shortest distance between the second coupling pin and the center of the second control shaft is set to be larger than a radius of a journal portion of the second control shaft, which is rotatably supported by a housing.

10. The variable compression ratio internal combustion engine as claimed in claim 1, wherein the coupling mechanism further comprises:

a second control shaft that is arranged in parallel with the first control shaft and is coupled with the first control shaft by the lever; and a second coupling pin for rotatably coupling a tip end of the second arm portion extending outward in a radial direction from a center of the second control shaft and the another end of the lever, wherein the first control shaft is arranged in an inside of the engine body, wherein the second control shaft is received and arranged in a housing that is attached to a side wall of the engine body, and wherein the lever passes through a slit formed through the side wall of the engine body.

11. The variable compression ratio internal combustion engine as claimed in claim 1, wherein the coupling mechanism further comprises a second control shaft that is connected to the actuator, the second control shaft being arranged in parallel with the first control shaft and being coupled with the first control shaft by the lever.

* * * * *